United States Patent [19]

Wright

[11] Patent Number: 4,516,886

[45] Date of Patent: May 14, 1985

[54] COMBINED RESIN-MECHANICAL MINE ROOF SUPPORT ANCHOR

[75] Inventor: Raymond L. Wright, Syracuse, N.Y.

[73] Assignee: The Eastern Company, Naugatuck, Conn.

[21] Appl. No.: 610,042

[22] Filed: May 14, 1984

[51] Int. Cl.[3] ..... E21D 20/02

[52] U.S. Cl. ..... 405/261; 411/47

[58] Field of Search ..... 405/259, 260, 261; 411/15, 44, 45, 47, 57, 60

[56] References Cited

U.S. PATENT DOCUMENTS

| | | | |
|---|---|---|---|
| 3,702,060 | 11/1972 | Cumming | 405/261 |
| 3,877,235 | 4/1975 | Hill | 405/261 |
| 4,413,930 | 11/1983 | Calandra | 405/261 |
| 4,437,795 | 3/1984 | White | 405/259 |

*Primary Examiner*—David H. Corbin

*Attorney, Agent, or Firm*—Charles S. McGuire

[57] ABSTRACT

A mine roof mechanical anchor having the usual expansion shell and tapered nut is fitted with a bail having legs secured to the shell and a medial portion extending over and contacting the nut, maintaining the latter in assembled relation with the shell, and having an opening aligned with and slightly smaller than the threaded opening in the nut. Bail extension structure, having a pair of legs attached to the legs of the first bail and a medial portion aligned with and spaced from that of the first bail, provides a means of breaking the casing and mixing the contents of a standard resin cartridge inserted in a bore hole in a mine roof ahead of the anchor and threaded bolt or rebar on which it is supported. The anchor and associated structure are rotated together with the roof bolt or rebar due to interference thereof with the smaller opening in the medial portion of the bail. After the resin cartridge is broken and contents mixed, rotation is stopped for a few seconds to allow the resin to begin to set and restrain further rotation of the anchor. When rotation is resumed the bolt or rebar is forced through the opening in the bail, but the tapered nut is not advanced to expand the shell until the end of the bolt or rebar contacts the medial portion of the bail extension structure. The bolt may then be tensioned and is anchored mechanically and by the hardened resin.

8 Claims, 6 Drawing Figures

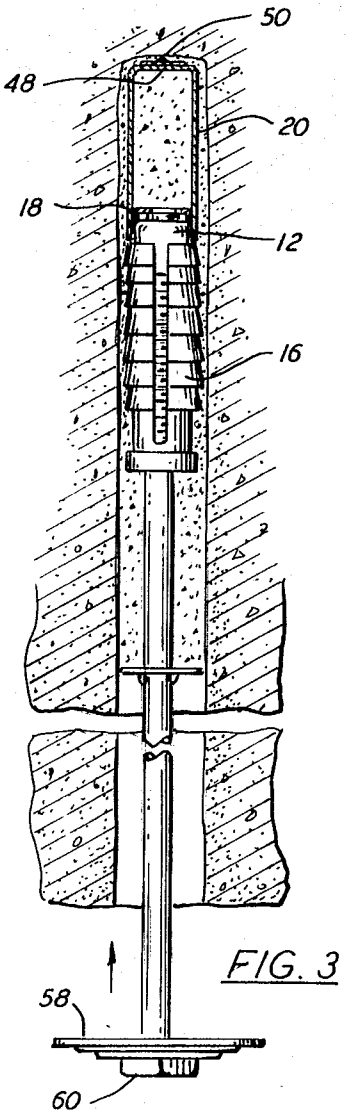
FIG. 3
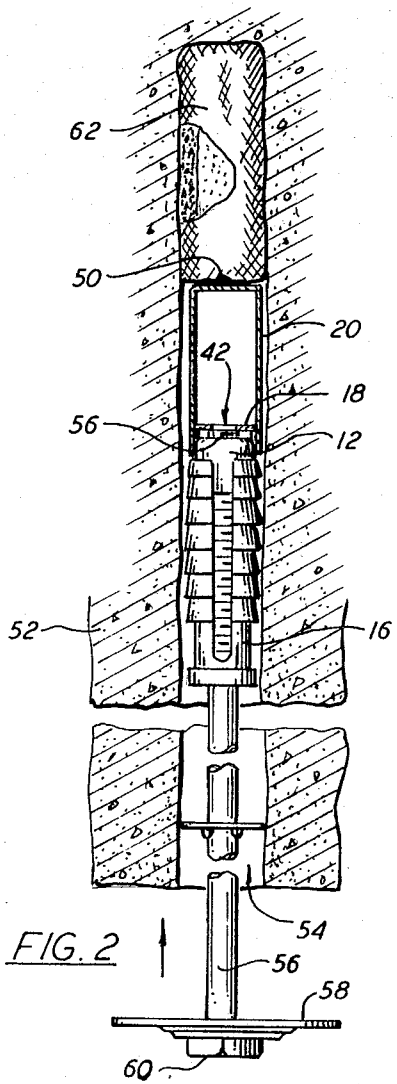
FIG. 2
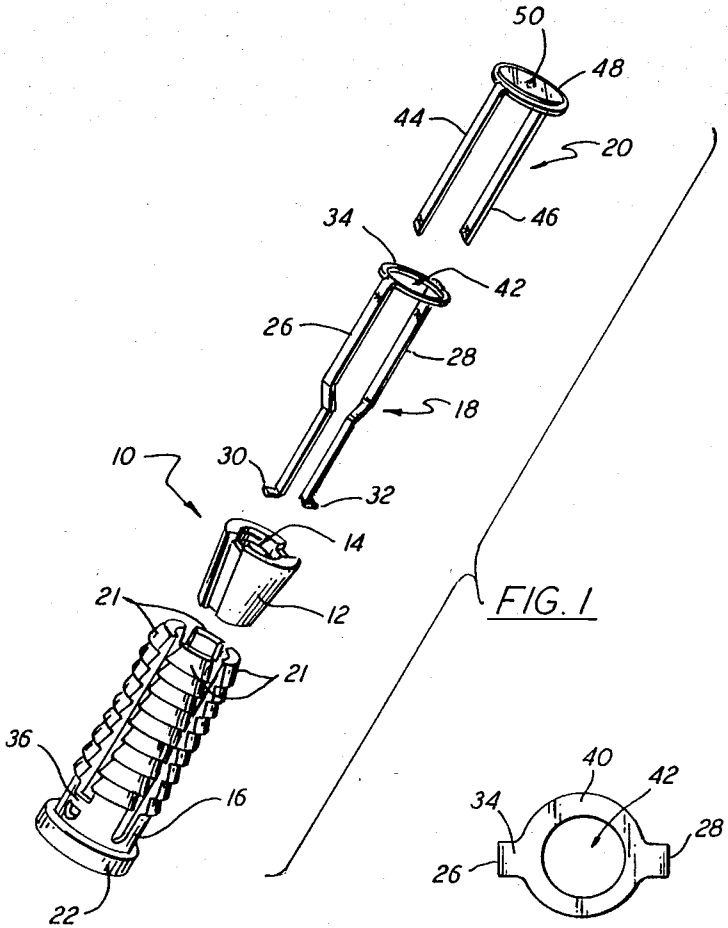
FIG. 1
FIG. 1a

COMBINED RESIN-MECHANICAL MINE ROOF SUPPORT ANCHOR

BACKGROUND OF THE INVENTION

The present invention relates to anchoring means for mine roof structures and the like, and more specifically to anchor systems of the type utilizing both a mechanical expansion anchor and a hardened resin to anchor the end of a mine roof bolt or threaded rebar in a drill hole.

Among the most common means of supporting the roofs and stabilizing and reinforcing rock strata in underground mines is an elongated rod, such as a bolt or rebar, having one end anchored firmly in a drill hole in the rock formation and the other end extending outside the opening to hold a bearing plate in tight engagement with the portion of the roof surrounding the bore hole opening. Anchor means for the elongated rods include mechanical expansion anchors wherein a tapered nut is advanced down the threaded end of the rod to expand a shell into gripping engagement with the walls of the bore hole, resin grouting means, and combinations of the two, among others.

In combination anchors, such as disclosed, for example, in U.S. Pat. Nos. 4,162,133, 3,324,663 and 2,829,502, a two-compartment resin cartridge is inserted in the drill hole ahead of the expansion anchor, the tapered nut of which is threaded on the end of the bolt or rebar. When the resin cartridge is engaged against the blind end of the hole, continued advancement and rotation of the bolt and anchor in one direction or the other, depending on the design of the unit, breaks the cartridge and mixes the two initially isolated components to permit the resin to harden. The bolt is then rotated to cause the tapered nut to expand the shell into engagement with the drill hole wall, the bolt is tensioned to the desired degree, and is anchored by the combined holding power of the expansion anchor and the hardened resin. While a number of such combination anchors have been provided, it is sometimes difficult to insure that the mechanical anchor goes into expansion at the desired time and/or the design requires custom casting or machining of the expansion anchor elements.

It is a principal object of the present invention to provide a combination mechanical expansion and resin grouted mine roof bolt anchor which utilizes tapered nuts and expansion shells of andard, commercially available design.

Another object is to provide a combination mechanical-resin bolt anchor system having novel and improved means for rotationally coupling the bolt and expansion anchor as the resin cartridge is broken and its contents mixed, and thereafter causing the shell to expand in the proper manner.

A further object is to provide a mechanical expansion anchor having combined structure which facilitates both the breaking of a resin cartridge and expansion of the shell at the desired point in the installation cycle.

Other objects will in part be obvious and will in part appear hereinafter.

SUMMARY OF THE INVENTION

In accordance with the foregoing objects, the invention contemplates a mine roof bolt anchor system employing standard, commercial designs of both the resin cartridge and the malleable cast iron tapered nut and expansion shell of the mechanical anchor. In many commercial designs of mechanical expansion anchors, the tapered nut and shell are retained in assembled relation by an essentially U-shaped strap or bail, having a pair of legs secured to or by portions of the shell and joined by a medial portion extending over the nut. This is likewise the case with the expansion anchor of the present invention; however, the medial portion is so formed that it rotationally couples the expansion anchor to the threaded bolt or rebar which extends through the shell and nut to bear against the medial bail portion, until a certain excess torque is applied to the bolt while restraining rotation of the anchor.

Additional structure, termed a "bail extension," is attached to the bail and extends therefrom along the extended axis of the bolt and anchor to a terminal portion having a protruding point or tooth. In the illustrated embodiment, the bail extension is similar in form to the bail, having a pair of legs joined by a medial portion. The two legs are fixedly attached, e.g., by welding, to the respective legs of the bail and the medial portion is aligned with and spaced from the medial portion of the bail, along the bolt axis. The medial portion of the bail has a width great enough to accommodate a circular opening having a diameter slightly smaller than that of the bolt.

In operation, a standard, two-compartment resin cartridge is inserted in a drill hole in the mine roof, followed by the anchor assembly of the invention carried on the end of a roof bolt or threaded rebar section. The bolt extends through the shell and is threaded through. the tapered nut in the usual manner until the end bears against the medial portion of the bail in the area surrounding the opening therein. The bolt is inserted in the drill hole until the resin cartridge is forced against the end. Continued advancement and rotation of the bolt causes the point on the bail extension to break the inner and outer casings of the resin cartridge, and the components are mixed to cause the resin to harden since the anchor is rotated together with the bolt due to the interference of the medial portion of the bail with the end of the bolt.

After full insertion and mixing of the resin, rotation is stopped for a few seconds to allow the resin to harden sufficiently to restrain further rotation of the anchor. When rotation of the bolt is resumed, application of torque beyond a certain threshhold limit will cause the bolt to break through the opening in the bail medial portion and continue threaded advance through the tapered nut, until making contact with the medial portion of the bail extension. Continued rotation of the bolt then causes the tapered nut to travel axially down the bolt, expanding the anchor shell outwardly into tightly gripping engagement with the wall of the drill hole. The bolt is then anchored by the combined holding power of the mechanical anchor and the hardened resin.

BRIEF DESCRIPTION OF THE DRAWINGS

FIG. 1 is an exploded perspective view of the expansion anchor assembly of the invention;

FIG. 1*a* is an enlarged, top plan view of one of the elements shown in FIG. 1;

FIG. 2 is a vertical section of mine roof, showing the anchoring system of the invention in elevational view in a first stage of installation in a drill hole in the mine roof; and FIGS. 3, 4 and 5 are views as in FIG. 2 showing the anchoring system at intermediate and final stages of installation.

DETAILED DESCRIPTION

Figure 5:
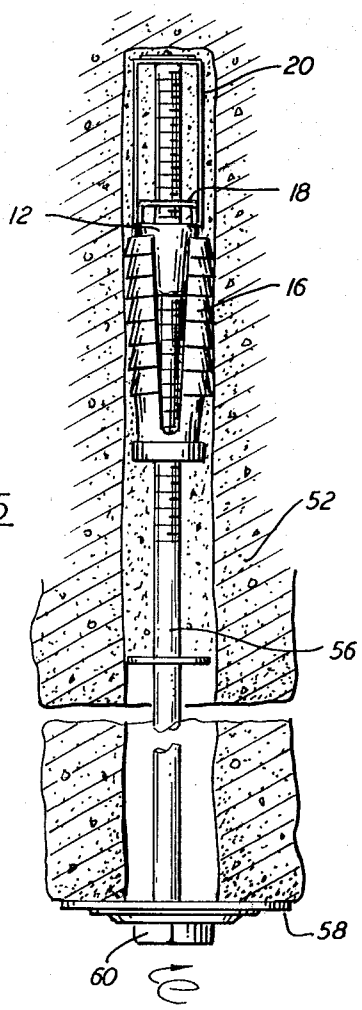

Referring now to the drawings, the expansion anchor portion of the anchoring system is shown separately from the other elements in FIG. 1 and denoted by reference numeral 10. Expansion anchor 10 includes tapered nut 12, having internally threaded through bore 14, expansion shell 16, bail 18 and bail extension 20. Nut 12 and shell 16 may be, and preferably are, of entirely conventional, commercially available desion, those shown in the present application, for example, being the same as in the anchor manufactured and sold by the Frazer and Jones Co. division of applicant's assignee under the designation FD8B, although a wide variety of other designs may be employed. Both nut 12 and shell 16 are malleable iron castings, the illustrated shell having four expansion leaves or fingers 21, integrally joined at one end of each by ring 22. Bail 18 and bail extension 20 are preferably metal stampings of a suitable corrosion resistant steel.

The smaller end of tapered nut 12 is placed in the end of shell 16 opposite ring 22 and is retained in such assembled position by bail 18, having a pair of legs 26 and 28 with outwardly bent tabs 30 and 32 at the respective free ends thereof and joined by medial portion 34. When assembled with the nut and shell, legs 26 and 28 extend through the spaces between fingers 21 on opposite sides of the shell, and bail 18 is retained in position by inserting tabs 30 and 32 under bridge portion 36 which extends across the spaces between two of the fingers, and an identical bridge portion between the fingers on the opposite side of the shell. This construction and arrangement is more fully shown and described in U.S. Pat. No. 4,278,006. Bail 18 of the present invention differs from that of the aforementioned patent, and from other prior art bail configurations, in the provision of widened part 40 in medial portion 34, of generally circular configuration and having circular opening 42 therethrough, as seen more clearly in FIG. 1*a*.

Besides the difference in bail configuration, the expansion anchor of the present invention differs from those of the prior art by the provision of bail extension 20, having a configuration similar to that of bail 18, including a pair of legs 44 and 46, joined by medial portion 48. Bail extension 20 is firmly affixed to bail 18, in the fully assembled oondition of the anchor, e.g., by welding legs 44 and 46 of the extension to bail legs 26 and 28, respectively, medial portion 48 being aligned with and spaced from bail medial portion 34 along the longitudinal axis of the anchor. In the stamping operation by which bail extension 20 is formed, a central part of medial portion 48 is cut and bent to provide piercing point 50, in the nature of a sharp tooth extending generally along the axis of the anchor.

Figure 4:
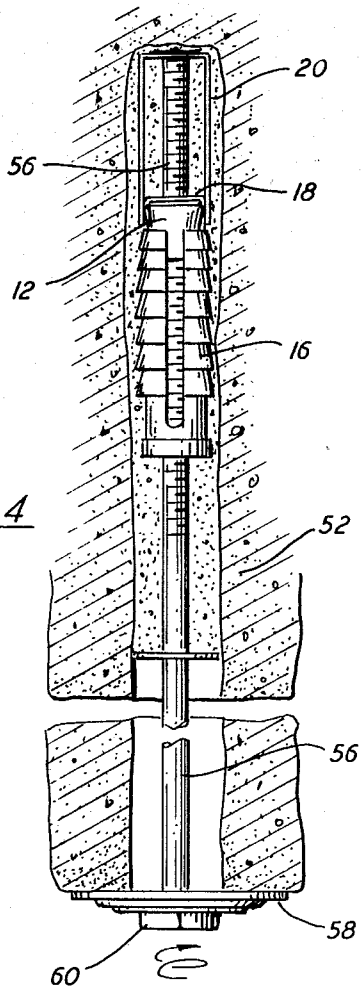

Operation of the anchoring system will now be explained, with reference to FIGS. 2–4. Reference numeral 52 denotes a cross section of a mine roof or other rock formation, having drill hole 54 of predetermined depth formed therein by conventional underground drilling ecuipment and procedures. An elongated rod 56, such as a section of rebar threaded from one end for a portion of its length, or a conventional mine roof bolt, is inserted through shell 16 threaded into tapered nut 12 until the end of the rod abuts medial portion 34 of bail 18. Rod 56 also extends through an opening in conventional bearing plate 58 which is retained by headed portion 60 of the rod, or by a nut installed on a lower portion of the rod in cases where the lower end is threaded. An important feature of the invention is the relationship between the diameters of rod 56 and opening 42. Rod 56 is of slightly larger diameter so that the end abuts the portion of medial portion 34 surrounding opening 42, as indicated by dotted line 56 in FIG. 1*a*, providing the operation hereinafter described.

A conventional cartridge 62 of resin grouting, available from a number of manufacturers, is inserted into drill hole 54, followed by anchor 10 supported on the end of rod 56. Cartridge includes an outer casing of flexible plastic containing two components which are initially separated by an inner casing and combine to form a mixture which quickly hardens upon breaking of the casings and mixing of the components. Rod 56 is inserted into drill hole 54 by means of conventional roof bolt installation equipment (not shown) which engages headed portion 60 and is adapted to advance the rod, and thereby anchor 10 and cartridge 62, axially as well as to effect rotation thereof.

Rod 56 is advanced axially until cartridge 62 reaches the end of drill hole 54, as the elements are shown in FIG. 2. Upon further axial advance of rod 56, piercing point 50 on bail extension 20 breaks the outer, and then the inner, casing of cartridge 62, allowing the resin components to mix and bringing the elements to the positions of FIG. 3. At this stage of installation, bearing plate 58 is still spaced from the surface of rock formation 52 and medial portion 48 of bail extension 20 is at, or a short distance from, the upper end of the drill hole. Rod 56 is preferably rotated as it is advanced axially from the positions of FIG. 2 to FIG. 3, or it may be moved to the FIG. 3 position and then rotated. In either case, anchor 10 is rotated together with rod 56 since opening 42 in medial portion 34 of bail 18 is of slightly smaller diameter than rod 56, whereby bail 18 provides a stop means, rotationally coupling the rod and anchor 10. For example, when using a one inch diameter rod, the diameter of opening 42 is preferably about 13/16 inch.

The rotation of rod 56, preferably in a clockwise direction, as it is advanced to cause piercing point 50 to break the cartridge or after it reaches the position of FIG. 3, serves to mix the two resin components in a few seconds. The material and dimensions of bail extension 20 and its attachment to bail 18 must, of course, provide sufficient rigidity that the resin cartridge will be broken and contents mixed in the described manner as rod 56 is advanced and rotated, without collapsing bail extension 20. Rotation is stopped with the components in the FIG. 3 position until the resin mixture begins to harden to the point that it will restrain anchor 10 against further rotation, usually an additional few seconds with the exact time dependent upon the particular resin materials used. Sufficient torque is then applied to rod 56 to cause the end thereof to break through opening 42 and advance through bail medial portion 34 until the end of the rod abuts medial portion 48 of bail extension 20, as shown in FIG. 4, at which point bearing plate 58 is firmly engaged against the surface of rock formation 52 surrounding drill hole 54.

Continued rotation causes tapered nut 12 to travel down the threads of rod 56 thereby expanding fingers 21 of shell 16 to engage the wall of drill hole 54. Anchor 10 thus functions in the usual manner of a mechanical expansion anchor and rod 56 may be tensioned to the desired degree. When the resin mixture has completely hardened, rod 56 is anchored in the drill hole by the combined holding power of the resin and of anchor 10, as well as being tensioned to compress and reinforce the rock strata of mine roof 52, as shown in FIG. 5.

What is claimed is:

1. An expansion anchor assembly for use on a threaded rod of predetermined diameter, in conjunction with a breakable cartridge of resin components which harden upon mixing to anchor said rod in a drill hole, in cooperation with said expansion anchor, the latter comprising, in combination:

(a) an expansion shell;

(b) a tapered nut having a threaded opening for engagement with said threaded rod and adapted to be advanced axially into said shell to effect outward, radial expansion thereof;

(c) bail means including a pair of bail legs secured on opposite sides of said shell and connected by a bail medial portion extending over said nut to retain the latter in assembled relation with said shell, said bail medial portion including breakable means positioned for contact by the end of said rod to limit the extent of advance thereof through said nut;

(d) a bail extension including a pair of extension legs connected by an extension medial portion having a sharp projection extending outwardly therefrom in a direction opposite to that of said bail medial portion; and (e) attachment means fixedly positioning said bail extension with respect to said shell and bail means with said extension medial portion aligned with and spaced from said bail medial portion along the axis of said anchor;

(f) said breakable means being constructed and arranged to cause said anchor to rotate together with said rod until application of a restraint to rotation of said shell, whereupon application of excess torque to said rod will cause said breakable means to fracture and permit further threaded advance of said rod through said nut until the end of said rod abuts said extension medial portion, continued rotation of said rod causing said nut to move axially thereon and expand said shell radially outward.

2. The invention according to claim 1 wherein said attachment means comprises a fixed attachment of said extension legs to said bail legs.

3. The invention according to claim 2 wherein said bail means comprises a unitary, sheet metal stamping, said bail legs being narrower and said bail medial portion wider than said predetermined rod diameter.

4. The invention according to claim 3 wherein said bail medial portion includes a through opening aligned with said rod and having a cross sectional dimension smaller than said predetermined rod diameter, said breakable means comprising portions of said bail medial portion surrounding said opening.

5. The invention according to claim 4 wherein said opening is circular and concentrically aligned with and of smaller diameter than said predetermined diameter.

6. The invention according to claim 5 wherein the diameter of said opening is between 80% and 90% of said predetermined diameter.

7. The invention according to claim 6 wherein said extension legs are of substantially the same width as said bail legs and are affixed thereto by welding.

8. A system for reinforcing and supporting a mine roof, or similar rock strata having a blind drill hole formed therein, said system comprising:

(a) an elongated rod of predetermined diameter threaded for a portion of its length from at least one end;

(b) an expansion anchor including a hollow, expansible shell and a tapered nut having a smaller end extending into said shell and a threaded opening extending therethrouoh for threaded engagement by said rod;

(c) bail means including a pair of legs joined by a medial portion, said legs being engaged with said shell to position said medial portion in engagement with and extending over the larger end of said tapered nut to hold the latter in assembled relation with said shell;

(d) said bail means medial portion having an opening therein coaxially aligned with said nut opening and of slightly smaller diameter than said predetermined diameter, whereby the end of said rod extending through said nut engages said medial portion about the periphery of said opening therein;

(e) a bail extension fixedly attached to said bail and extending therefrom to a position spaced from and aligned with said bail medial portion;

(f) a breakable resin cartridge for insertion in a drill hole in a rock formation ahead of said rod with said anchor carried thereon, said cartridge being advanced into said hole by engagement with said bail extension as said rod is advanced;

(g) said bail means and said bail extension being of such material and the difference in diameters of said medial portion opening and said rod being such that:

(i) said anchor, including said bail means and bail extension, is rotated as a unit with said rod as the latter is advanced into said drill hole and rotated, (ii) said bail extension is effective to break said resin cartridge and allow the components thereof to mix and harden, and (iii) said rod breaks through said medial portion opening upon application of excess torgue after the resin mix hardens sufficiently to restrain rotation of said anchor, thereby moving said tapered nut axially down said rod and into said shell to expand the latter into engagement with said drill hole and tension said rod.

* * * * *